United States Patent [19]

Breitenstein et al.

[11] 3,942,544

[45] Mar. 9, 1976

[54] HOPPER PAYOUT FOR VARIOUS COIN DENOMINATIONS

[75] Inventors: Charles T. Breitenstein, Elk Grove Village; Frank G. Nicolaus, Chicago, both of Ill.

[73] Assignee: Spiral Step Tool Company, Elk Grove Village, Ill.

[22] Filed: Aug. 1, 1973

[21] Appl. No.: 384,624

[52] U.S. Cl. ..... 133/4 R; 194/2

[51] Int. Cl.[2] ..... G07D 3/14; G07D 9/00

[58] Field of Search ..... 133/1, 2, 3, 4, 5, 8; 194/2

[56] References Cited

UNITED STATES PATENTS

| | | | |
|---|---|---|---|
| 1,914,362 | 6/1933 | Donnellan | 133/8 A |
| 2,675,007 | 4/1954 | Young et al. | 133/3 R |
| 2,906,276 | 9/1959 | Blanchette et al. | 133/3 R |
| 3,045,864 | 7/1962 | Hurst et al. | 133/8 R X |
| 3,187,760 | 6/1965 | Simjian | 133/4 R |
| 3,285,380 | 11/1966 | Sykes | 194/2 |
| 3,396,737 | 8/1968 | Picollo | 133/8 R X |
| 3,680,566 | 8/1972 | Tanaka et al. | 133/3 R |
| 3,754,558 | 8/1973 | Conant et al. | 133/8 R X |

*Primary Examiner*—Robert B. Reeves
*Assistant Examiner*—Joseph J. Rolla
*Attorney, Agent, or Firm*—Dominik, Knechtel, Godula & Demeur

[57] ABSTRACT

A hopper payout for various coin denominations is disclosed having a hopper, a rotary pin wheel, removably secured shelf wheel, and delivery opening in which the pin wheel is suspended for rotation by means of rollers oriented at the periphery of the wheel on spaced centers. The shelf wheel is removable and replaceable with differing diameter shelf wheels to accommodate varying denominations of coins. A centrally disposed agitator is similarly removable and interchangeable. The knife which removes coins from the shelf wheel is pivotally mounted to accommodate varying diameters of the varying coin dimensions. A uniformly widening coin gutter is provided to reduce the tendency of the coins to jam and shingle, irrespective of denomination and size. In order to adjustably accommodate the varying weights of coins within the hopper to divert the flow of coins into the permanent coin reservoir, the hopper is pivotally secured to the frame, and a yieldable means having a preselected resiliency secures the same against pivoting. Thus an empirical determination of the number of coins to be held in the hopper before bypassing to the permanent collection member can be made by service personnel in the field.

35 Claims, 19 Drawing Figures

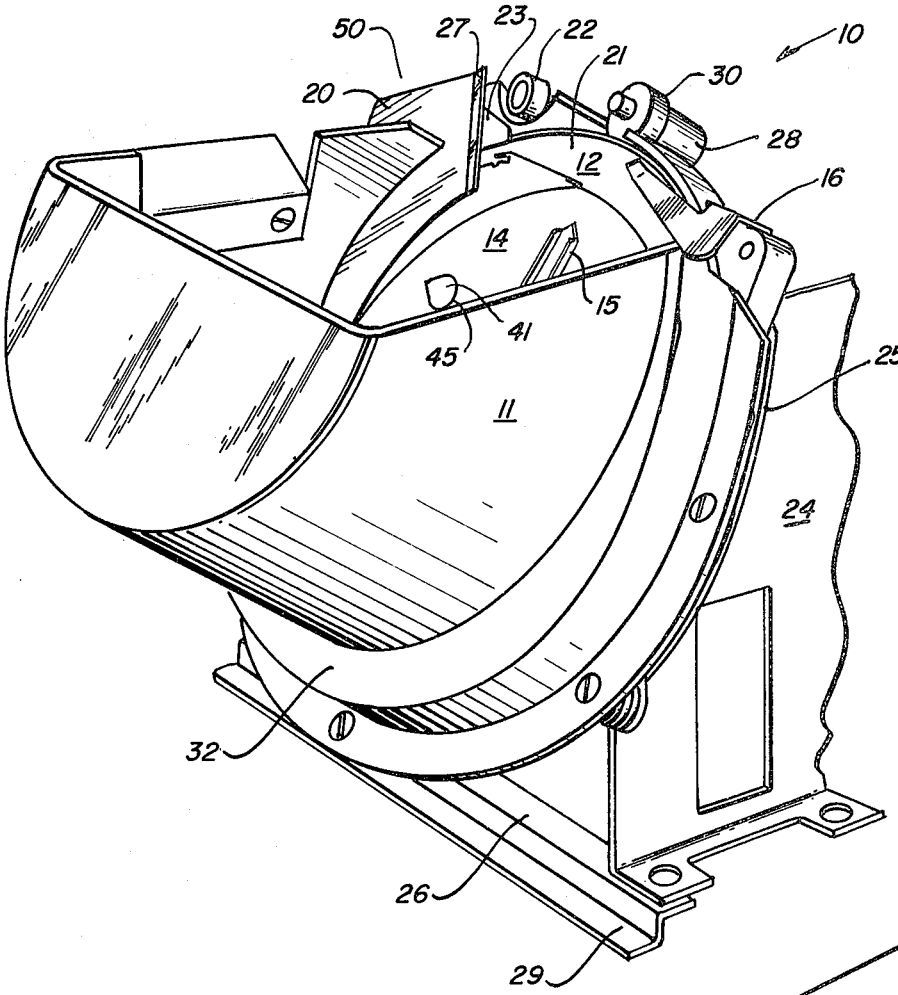
FIG. 1
FIG. 2
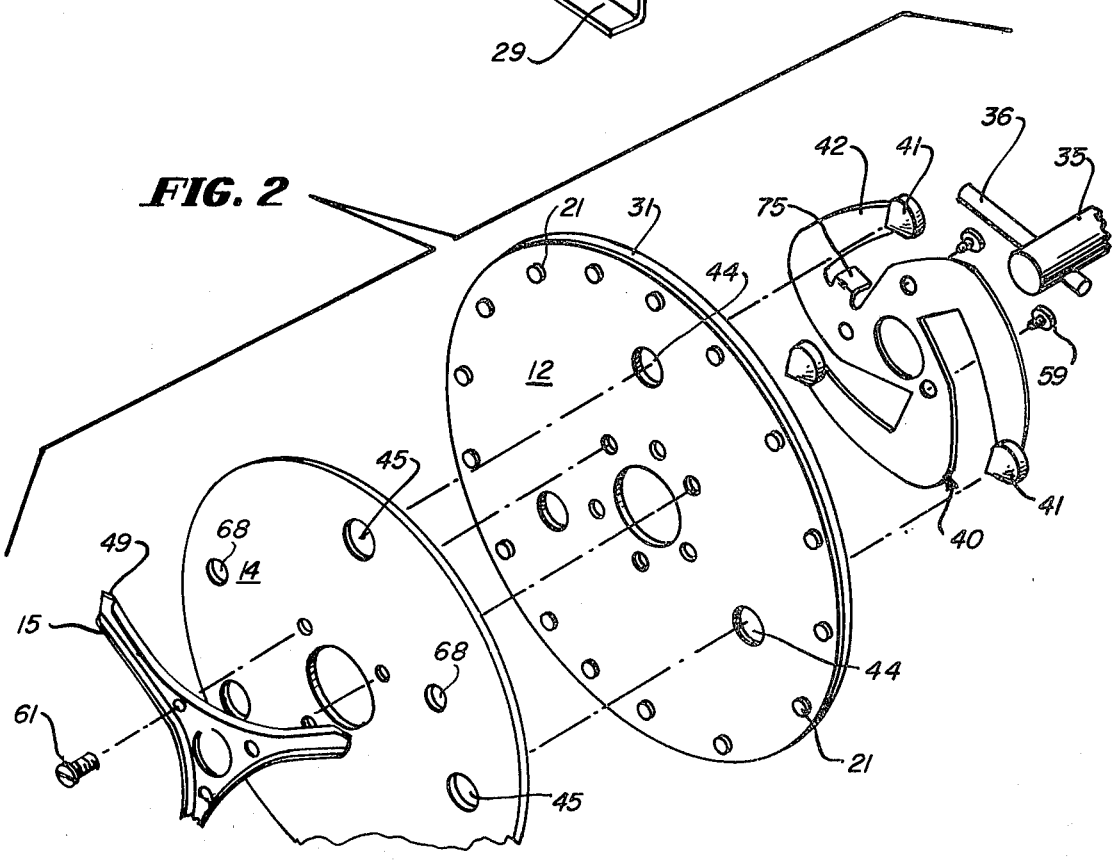

FIG. 3
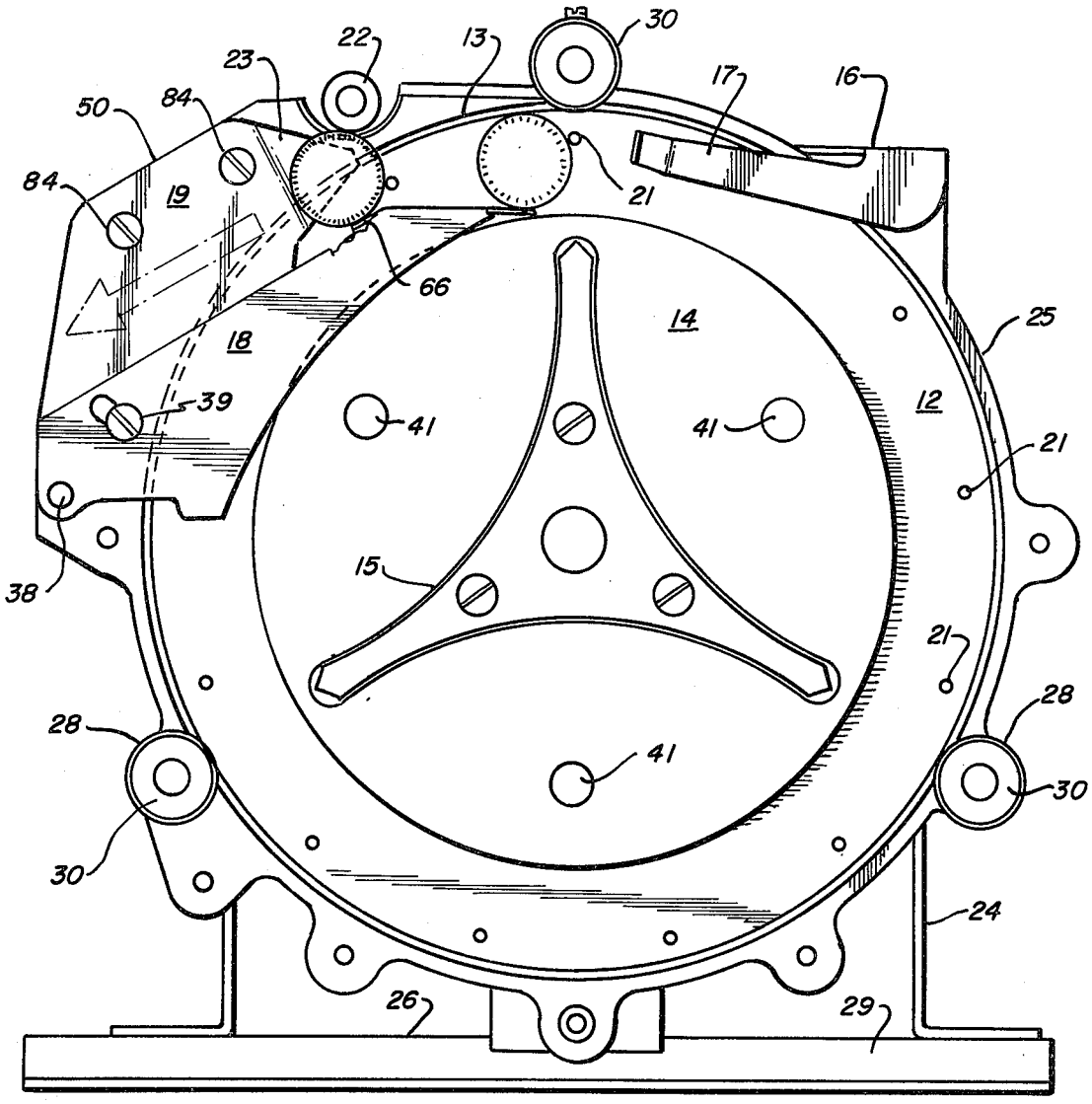
FIG. 4
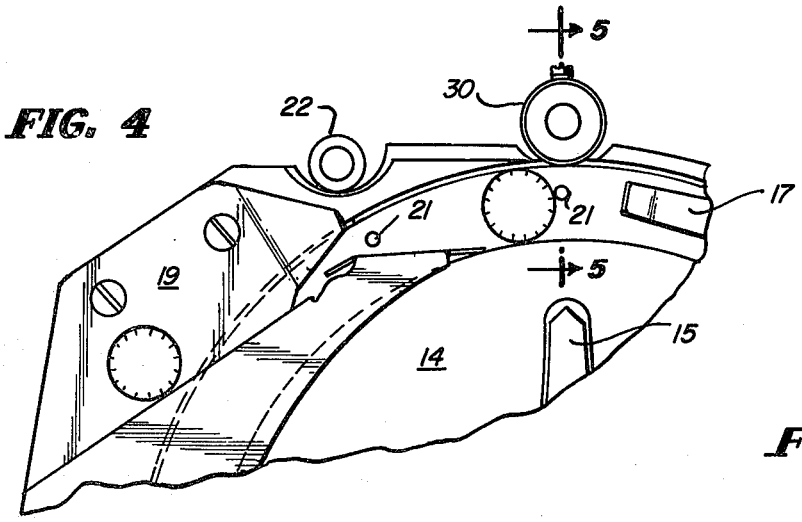
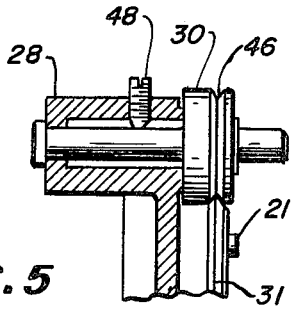
FIG. 5

FIG. 8
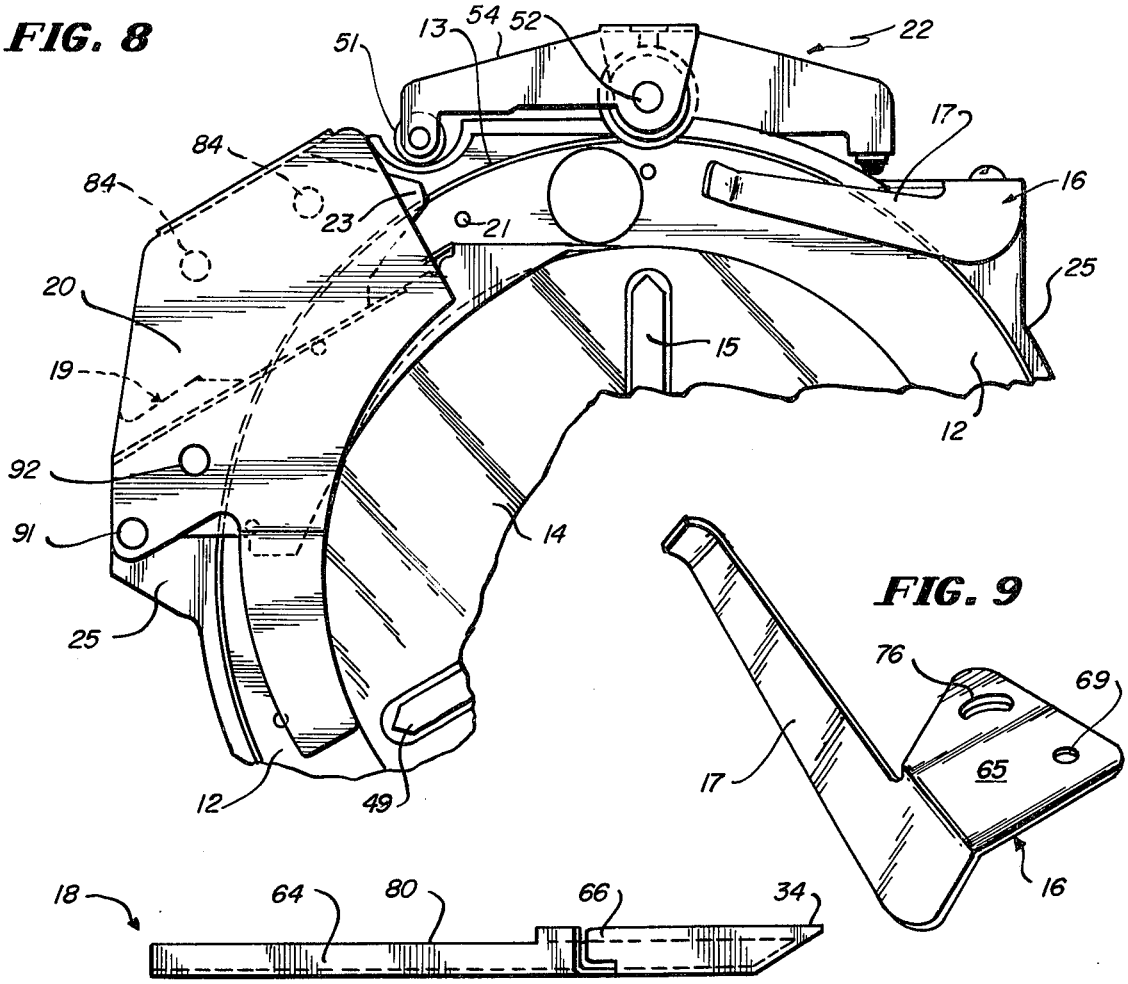
FIG. 9
FIG. 12
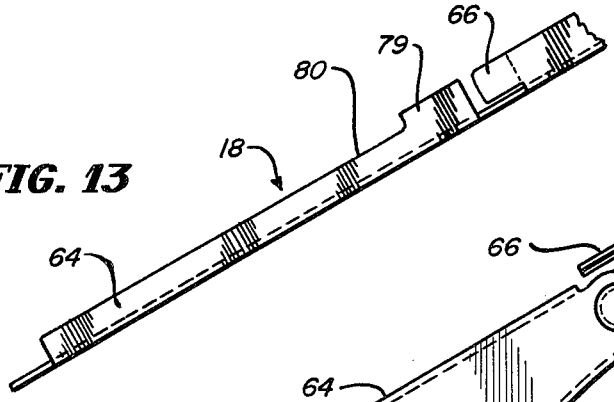
FIG. 13
FIG. 11
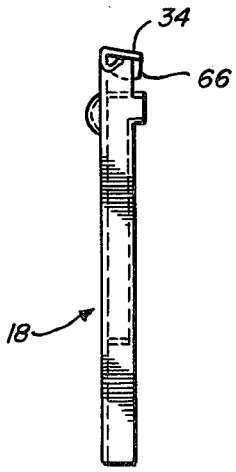
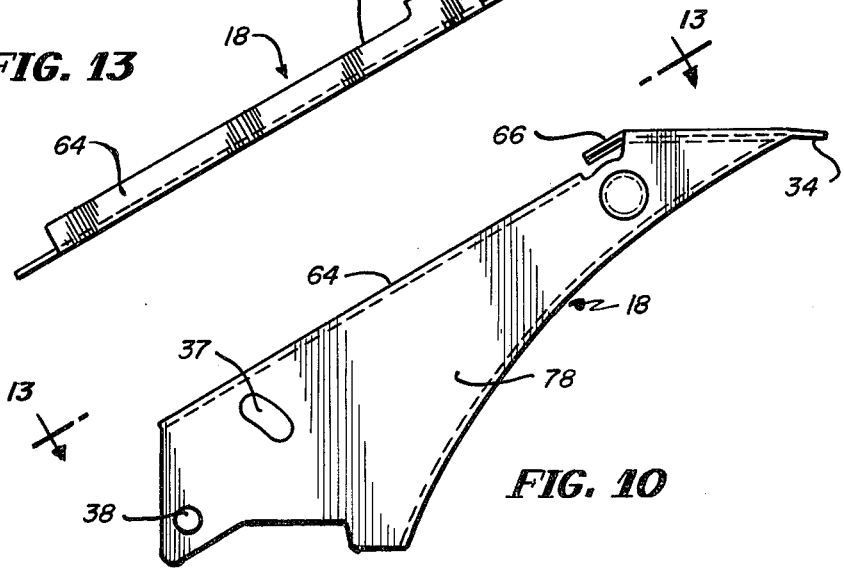
FIG. 10

FIG. 17
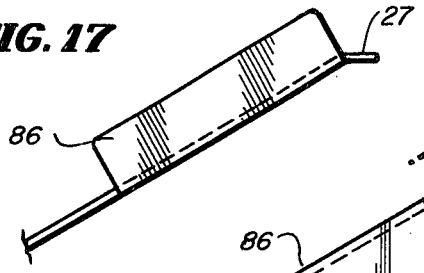
FIG. 15
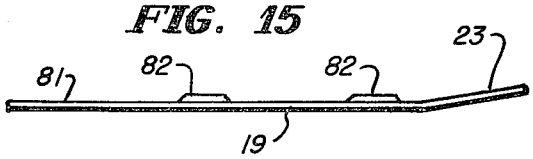
FIG. 14
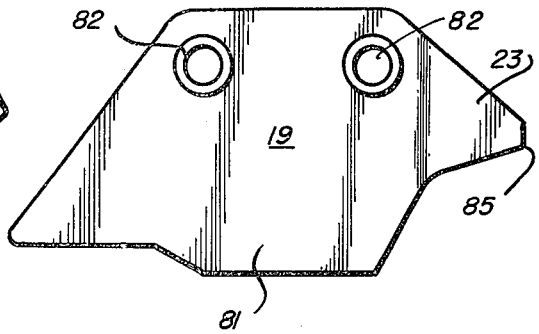
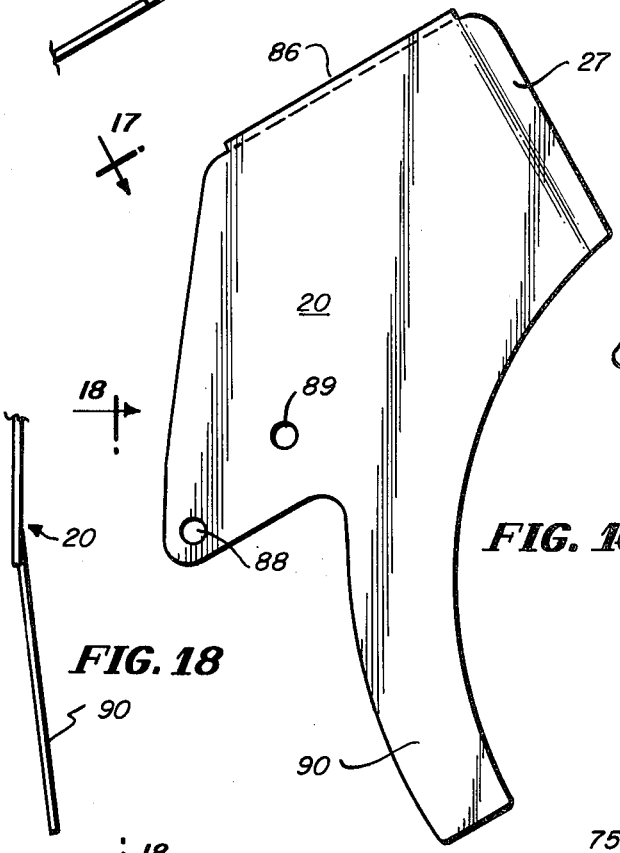
FIG. 16
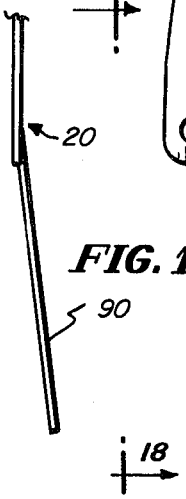
FIG. 18
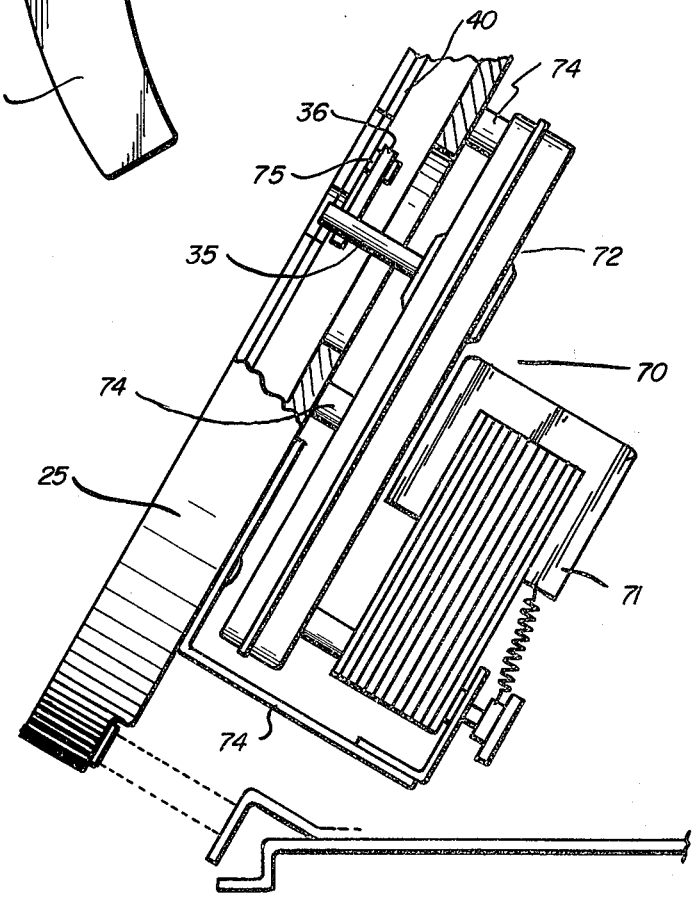
FIG. 19

HOPPER PAYOUT FOR VARIOUS COIN DENOMINATIONS

BACKGROUND OF THE INVENTION

1. Field of Invention

The subject invention relates to hopper payout mechanisms, and more particularly those which are commonly used to deliver a preselected number of coins to a delivery chute. Such products appear classified in Patent Office Class 194, Sub-Class 2, amongst others.

2. Discussion of the Prior Art

U.S. Pat. No. 3,285,380 is illustrative of the prior art. As disclosed, the coin counter has a rotary member and delivery chute including a hopper. A positive drive, however, is provided at the center of the pin wheel, which precludes the maintaining of precise dimensional accuracies at the periphery of the pin wheel. In addition, the shelf wheel in combination with the pin wheel and wiper are permanently designed for specific coin denominations, that is, by diameter and thickness.

Where several coin counting installations are involved, for purposes of service, it becomes increasingly important to maintain spare hopper payout mechanisms adaptable for the various coins involved. Where international trade is concerned, coin counting units must be capable of accommodating a wide variety of diameters and thicknesses. Most of the coin counting devices of the prior art require extensive modification, if not replacement for varying sizes of coins. For example, with United States coins separate hopper payout mechanisms are required for dimes, nickels, quarters, and half-dollars. Necessarily, a manufacturer contemplating export, must make even additional models in order to export for use with the wide variety of foreign coin denominations, thicknesses, and diameters.

SUMMARY

A hopper payout mechanism for various coin denominations is disclosed which is readily modified for use with a wise variety of coin sizes, both as to thickness and diameter. Anti-jamming features are provided in connection with the present invention, in addition to interchangeable elements designed for the accommodation of numerous coin diameters and thicknesses. A central crank type drive mechanism is employed with the pin wheel journalled at its periphery to thereby precisely position the pin wheel. The coin gutter at the bottom of the hopper widens progressively at a steadily increasing helical configuration to thereby relieve the tendency of coins of various diameters and thicknesses to shingle at the bottom of the gutter and lower portion of the hopper. A coin wiper is positioned immediately ahead of the counter to insure that only a single coin is nested between two adjacent pins on the pin wheel, prior to engaging the pivotally adjustable knife. The delivery chute is provided with a cover plate and interior deflector designed to receive the coin when it is accelerated outwardly after being counted, and the counter returns to its preset position thereby accelerating the coin, and quickly prepositioning itself for further counting. To avoid overloading or spilling the hopper, the same is, along with the rotating of the mechanism, pivotally supported to a frame and yieldably adjustable so that it can be preselectedly set to bypass coins when a given quantity, determined imperically by weight, of coins are present within the hopper.

In view of the foregoing, it is a principal object of the present invention to provide a hopper payout mechanism for various coin denominations which can be, with a few relatively inexpensive parts, converted and adjusted for a wide variety of coin diameters and thicknesses.

Still another object of the present invention is to provide a hopper payout mechanism for various coin denominations which can be formed from a plurality of stampings and castings, thereby reducing costs, and yet because of the suspension and mounting of the rotating parts, precise dimensional accuracies can be maintained.

A further important object of the present invention is to provide a hopper payout mechanism for various coin denominations which requires only a small inventory of spare parts to render the same interchangeable for the various sizes of coins in the machines for which the hopper is intended.

Still another object of the present invention is to provide a hopper payout mechanism for various coin denominations which has jam-relieving characteristics irrespective of sizes of coins as exemplified by United States dimes, nickels, quarters, and half-dollars.

Not to be overlooked is an important object of the present invention to achieve all of the foregoing objectives in a unit which is designed to have inherent manufacturing economies.

DESCRIPTION OF DRAWINGS

Further objects and advantages of the present invention will become apparent as the following description of an illustrative embodiment proceeds in which:

FIG. 1 is a perspective view of the illustrative hopper payout.

FIG. 2 is an exploded enlarged perspective view of the principal rotating elements.

FIG. 3 is a front elevation in enlarged scale of the hopper payout mechanism with the hopper removed to show the principal rotating and orienting elements.

FIG. 4 is an enlarged broken view of the counting and pick-off portion of the hopper payout mechanism shown in FIG. 3, taken in enlarged scale.

FIG. 5 is a transverse broken sectioned view of the roller suspension of the pin wheel taken at section line 5—5 of FIG. 4.

FIG. 8 is an enlarged broken view of the counter mechanism.

FIG. 9 is an illustrative perspective view of the wiper.

FIG. 10 is a plan view of the knife.

FIG. 11 is a front view of the knife taken from the right hand portion of FIG. 10 and in the same scale.

FIG. 12 is a top view of the knife shown in FIG. 10.

FIG. 13 is an angled top view of the knife taken from the vantage point illustrated as 13—13 of FIG. 10.

FIG. 14 is a plan view of the deflector.

FIG. 15 is a top view of the deflector.

FIG. 16 is a plan view of the outlet cover.

FIG. 17 is a partial top view of the deflector cover taken from vantage point 17—17 of FIG. 16.

FIG. 18 is an end view of the deflector cover taken from vantage point 18—18 of FIG. 16.

FIG. 19 is an enlarged partially broken view of the drive mechanism illustrating the relationship between the motor, gear box, drive pin, and pin wheel.

DESCRIPTION OF PREFERRED EMBODIMENT

Figure 7:
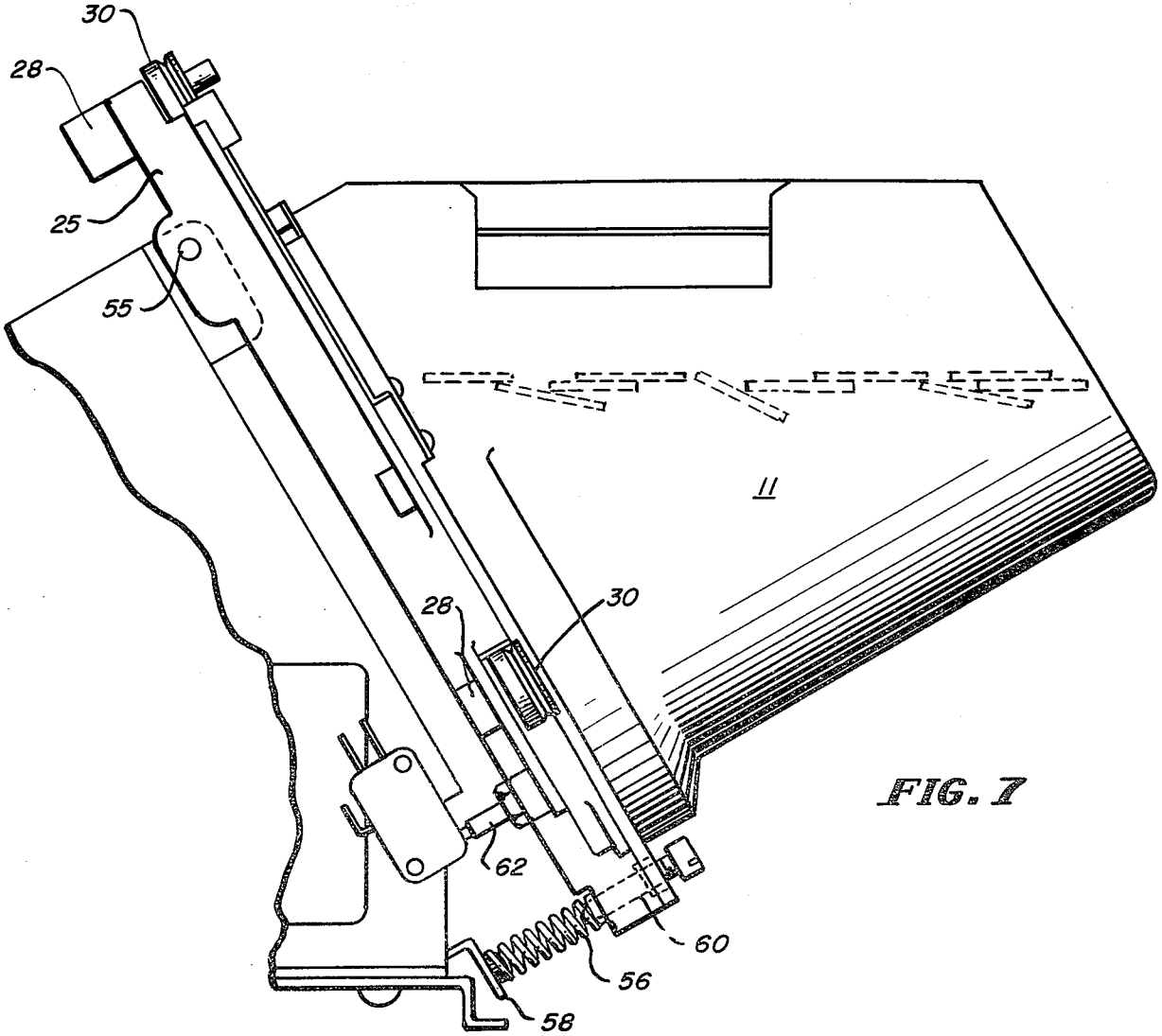
FIG. 7 is a side elevation of the hopper payout, partially broken in the drive mechanism portion, illustrating in phantom lines the level to which the coins are randomly permitted to collect, and showing also the yieldable means and pivotal suspension of the hopper provided to bypass coins when a preselected weight level of coins are in the hopper.

With reference to FIG. 1, it will be seen that the hopper payout for various coin denominations 10 includes a scoop-shaped hopper 11, the same being mounted to a wheel housing 25 which, in turn, is supported on the side brackets 24, the latter being secured to the frame 26 which includes base rails 29 for sliding the hopper 10 in and out of the gaming machines for which it is intended to gather and pay out coins. Interiorly of the hopper 11, is a rotating pin wheel 12. The pin wheel 12 has a plurality of pins 21 located along its periphery to engage for counting and discharge, individual coins. The coins are supported between the pins 21 on a shelf wheel 14. An agitator 15, illustrated as a three-legged member, is positioned centrally on the shelf wheel 14 to agitate the coins within the hopper 11, and permit the same to become aligned in the gutter 32 of the hopper 11.

More specifically, as shown in FIG. 2, a cone spider 40 is positioned behind the pin wheel 12. The cone spider 40 has a plurality of cones 41, here shown being three in number, on yieldable cone supporting legs 42. When the cone spider 40 is secured to the rear portion of the pin wheel 12, and the shelf wheel 14 and its agitator 15 secured in the sequential relationship as shown in FIG. 2, the cones 41 penetrate the pin wheel cone holes 44 and the shelf wheel cone holes 45 to project through the face of the shelf wheel 14 as illustrated in FIGS. 1 and 3.

In operation the pin wheel 12, as shown in FIGS. 1 and 3, is rotated in the counter-clockwise direction. The coins pass first from the hopper 11 into the gutter 32. Because the pin wheel 12 and related elements are positioned at an angle (see FIG. 7), the coins are gravitationally urged into the gutter 32. The coins are then agitated by means of the agitator 15, and are engaged by the pins on the outer portion of the pin wheel 12. Coins can, of course, overlap on the periphery of the pin wheel 12 until, as shown in FIG. 3, they approach the two o'clock position. At this point, the wiper 16 engages any overlapping coins and wipes them back into the hopper 11. Those coins which pass beyond the top of the shelf wheel 14 are then engaged by the knife 18. The knife 18 includes an engaging point 34 at its forwardmost portion. As illustrated in FIG. 3, a coin is immediately atop the point 34 of the knife 18. The coin then proceeds across the knife 18 until it engages the yieldable counter 22. If the counter 22 is preset to pass five coins, after it has counted five coins it will turn off the drive mechanism for the hopper payout, and the last coin is accelerated by the yieldable action of the counter 22 into the coin discharge chute 50. The latter is made up of a coin deflector 19 in the interior portion which has a bevelled nose portion to engage and deflect the coin centrally. A cover plate 20, which is the outlet cover, overlies the coin deflector 19. The cover plate 20 is shown in FIG. 1, whereas the coin deflector 19 which is immediately behind the cover plate 20 is shown in FIG. 3. The coins then pass freely outwardly.

It will be appreciated that the knife 18 is secured at its pivot 38, and adjustably positionable by means of the securing mechanism 39, as shown in FIG. 3. Therefore, when varying diameter shelf plates 14 and agitators 15 are positioned on the pin wheel 12 to accommodate differing size coins, the knife 18 is moved by means of the securing mechanism 39 around the pivot 38, so that the point 34 wil remain substantially tangential to the periphery of the shelf plate 14. To additionally assist in agitating the coins within the hopper 11, a coin spider 40 is positioned behind the pin wheel 12 and shelf wheel 14 respectively, as shown in FIG. 2. The cones 41, as pointed out before, are yieldably secured to the cone spider 40 by means of the cone spider legs 42, and serve to yieldably assist the agitator 15 in connection with maintaining an even flow of coins into the gutter 32 and thereafter onto the pin wheel 12 between the pins 21.

In order to insure dimensional stability for the pin wheel 12 and its associated moving members, a knife edge 31 is formed at the periphery of the pin wheel 12, and is engaged by a plurality of rollers 30, each having a corresponding knife edge groove 46, as shown in greater detail in FIG. 5. In this construction, implemented by adjusting screw 48 as shown in FIG. 5, or a yieldable adjusting mechanism (not shown), permits a fine tuning of the support of the pin wheel 12 by means of the rollers 30, here shown as three in number. Each of the rollers 30 is preferably secured to a bearing mount 28 on the wheel housing 25. Roller or ball bearings provide for friction reduced rotation, and yet because of the adjusting screws 48 or their equivalent yieldable members, permit a precise positioning of the pin wheel 12. It will be particularly appreciated in connection with FIGS. 3 and 4 that the precision of positioning occurs between the upper roller 30 and the counter 22, since at this point the coin is transferred from the pin wheel 12 onto the point 34 and thence the knife 18 into the coin chute assembly 50.

Figure 6:
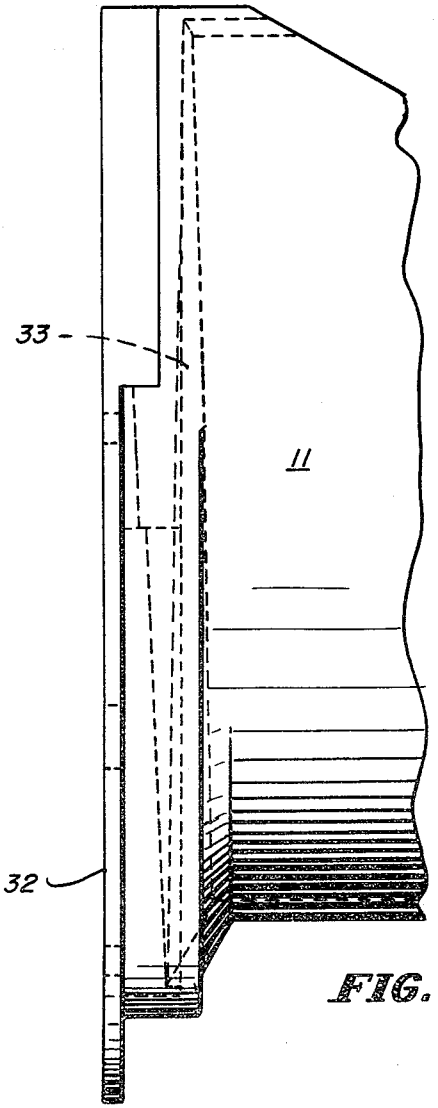
FIG. 6 is a partially broken transverse view of the hopper showing how the gutter enlarges progressively from bottom to top as coins are moved from the gutter and transferred onto the pin wheel.

As pointed out earlier, a very important aspect of the present invention is in the construction of the hopper 11, and more particularly, the gutter 32. By reference to FIG. 6, as well as the exterior of the hopper 11 as shown in FIG. 1, it will be seen that the gutter 32 as well as the gutter relief 33 has a progressively opening helical proportioning as the coins travel around the gutter 32 and are picked up by the pins 21 on the pin wheel 12. Because the pin wheel 12 is mounted with precision by means of the roller 30, a similar precision can be developed in the helical relief of the gutter 32 and its gutter relief bevelled portion 33 so that as coins may be shingled at the bottom of the hopper 11, as the pins 21 and agitator 15 along with the cones 41 stir the collection of coins within the hopper 11, shingling and jamming which may take place is relieved as the gutter helix of the gutter 32 and bevelled relief 33 progressively widen throughout the throat portion of the hopper 11.

In order to proportion the total number of coins within the hopper 11 to match the amounts of pay, as well as to avoid overloading of the hopper 11 which would cause jamming, the hopper 11 and its associated structure including the housing 25 are pivotally secured to the frame by means of pivots 55 located at the upper portion of the side brackets 24. At the lower portion of the wheel housing 25, it will be seen that a spring 56 has been provided secured to a spring bracket 58. The spring 56 bears in compression against the lower portion of the wheel housing 25, and by means of a spring preloading screw 60, the compressive load on the spring 56 may be varied. Thus, when a sufficient weight of coins, shown in phantom in FIG. 7, has been arrived at, the weight of the coins pivotally within the hopper 11 around the pivots 55 will overcome the loading of the spring 56, and the frame 25 with its associated loaded hopper 11 will pivot in a clockwise direction, as shown in FIG. 7, around the pivots 55. This pivotal action actuates a switch 62 which in turn actuates a by-pass (not shown) to divert coins from the host device from the hopper 11 directly to the permanent coin chute 50 provided in the host.

As shown in FIG. 8, the counter 22 includes a counter wheel 51, and a pivot 52 along with an actuating member 54 which in turn is connected to the various counting structures, whether electronic or mechanical, provided in the host device. The counter is provided with yieldable means of varying orientations and proportions, so that as a coin engages the counter wheel 51, positioned at a space between the base of the counter wheel 51 and the upper edge of the shelf wheel 14 to positively engage a coin, upon passing the counter wheel 51, not only has a count been made, but the counter wheel 51 has been "cocked" to impart some velocity to the coin after the same has been counted and is forwarded to the delivery chute 50. This provides the additional function of the counter assembly 22 of accelerating the coins through the chute 50, and avoiding jams and piling within the chute 50.

The knife 18, as shown in FIGS. 10–13, includes the tapered point 34, and in addition the knife chute base portion 64 which defines the bottom portion of the chute 50. It will also be noted that the point 34 has a depending by-pass 66 which is oriented slightly above to the chute base 64. This further assists in accelerating the travel of the coin within the chute 50, after passing the counting mechanism 22 (see particularly the upper left hand portion of FIGS. 3 and 4).

In addition, the preconditioning wiper 16 shown in FIG. 9 has a tapered and yieldable finger 17 which is positioned to closely tangentially engage the pin wheel 12, and thereby insure that any coins apart from one thickness in the space between adjacent pins 21 are yieldably urged back into the hopper 11.

An alternative but also useful function is provided on the deflector 19, where a deflector tongue 23 is provided at its lead portion to approximately contact the periphery of the pin wheel 12 in the tongue recess 13, and in all events to engage the lead edge of a coin as the coin is passing beyond the counter mechanism 22 and over the bypass 66 of the knife mechanism 18. This structure is shown particularly in the view appearing in FIG. 8. The tongue portion 23 of the deflector 19 is proportioned so that its lower corner rides within a recess or offset 13 at the periphery of the pin wheel 12. Thus, as shown in FIG. 3, the tongue 23 is behind the coin, thereby avoiding the possibility of jamming, or the front edge of the tongue 23 contacting the edge of the coin rather than slipping beneath it to deflect it forwardly prior to passing down the chute 50. The outlet cover 20 is also shown in FIG. 8, where it will be seen that the outlet cover 20 has a gate member 27 which, in conjunction with the tongue 23 of the deflector 19, defines a pair of funnel-like converging members at the opening to the chute assembly 50. Thus, any coins which are deflected in a skewed direction after passing the counter 22 are urged back into alignment for accelerated discharge through the chute 50 as previously described.

The drive assembly 70 is shown in FIG. 19. There it will be seen that the drive assembly 70 preferably includes an electric motor 71, coupled with a motor brake 72 and gear box. The gear box has, extending from its drive-in portion, a drive shaft 35 and a drive pin 36. As described above, the drive pin 36, when the motor is operative and rotates the drive shaft 35, engages the drive pad 75 on the cone spider 40. The cone spider 40 is provided with three such drive pads 75, so that during assembly or interchange, precise positioning is not critical. Further to be noted are the motor mounts 74 which are secured to the wheel housing 25, thereby additionally assuring precise alignment of the drive mechanism, although tolerances can be permitted because of the crank pin type drive provided through the drive shaft 35 and the drive pin 36 against the drive pad 75.

Further additional details of construction will be observed in FIG. 2 where it will be seen that the agitator 15 is secured into position by means of screws 61 and at matching threaded holes in both the shelf wheel 14 and pin wheel 15. Bent ends 49 are provided at the ends of the agitator 25 and are nestingly received within the additional holes provided therefor in the shelf wheel 14. These holes are designated by reference numerals 68 in FIG. 2. The cone spider 40 is secured beneath by means of cone spider screws 59 into the rear portion of the pin wheel 12. It will be further appreciated that because the pin wheel 12 may be formed of a stamping, the pins 21 may be formed in the same stamping operation by means of pin forming members in the die. This insures precision in the formation of the pins 21 as well as inexpensive formation of the same. As shown in this unit, there are 16 pins spaced at equidistant radial spacings about the pin wheel 12.

For design purposes, the hopper gutter has a fixed 7.5 inches diameter (that portion concentric with the pin wheel) and fixed pin locations as discussed. Necessarily, this diameter can vary depending upon designed capacity and, thus, the 7.5 inches recited is primarily for illustration. The diameter of the shelf wheel A is then determined by the following formula:

$$A = B - (2d + 2t \pm .040)$$

where the following definitions are applied:

A: shelf wheel diameter, B: 7.500"
d: coin diameter, t: coin thickness

The other dimensions for the agitator 15, knife 18, and remaining parts are all proportioned to depend upon the formula for determining the diameter of the pin wheel as set forth above. It will be appreciated that because the entire unit is mounted on a base 26 having flanking rails 29, it can be readily inserted and removed from a host machine. Conveniently, at the option of the manufacturer, a handle may be provided for this purpose on either of the side brackets 24.

Specific details of the wiper 16 appear in FIG. 9 on the perspective view where it will be seen that a wiper mount 65 appears as an offset member from the wiper finger 17. A mounting hole 69 is provided, along with a slotted hole 76 which permits the wiper finger 17 to be swung for the proper spacing adjacent the pin wheel 12 to accommodate thicker or thinner coins depending upon which is being passed through the hopper payout.

The specifics of the knife 18 are shown in FIGS. 10 thru 13 inclusive. There it will be seen that the knife 18 has a body 78, from which the chute base 64 depends. Pointed out specifically in FIGS. 12 and 13 is the pin by-pass recess 80 which is an undercut portion of the chute base 64 "downstream" from the lead portion 79 of the chute base 64. To be further noted in FIG. 11 is the offset angle of the knife point 34, and the by-pass 66 to yieldably urge the coins toward the pin wheel 12, rather than away from the same as the coin is passing onto the knife point 34, for its subsequent travel down the by-pass 66 and the chute base 64. As pointed out earlier, a pivot 38 (see FIG. 10) and arcuate slot 37 are provided in the body 78 of the knife 18, so that the positioning of the knife 18 against the shelf wheel 14 for varying size coins may be accomplished by means of the securing mechanism 39, illustrated in FIG. 3 and described above.

Specifics of the deflector 19 are shown in FIGS. 14 and 15 where it will be seen that the same includes a body 81, along with the tongue 23, and mounting holes 82 to receive the mounting screws 84, as illustrated in FIG. 3 and shown in dotted lines in FIG. 8. As pointed out earlier, the front lower corner 85 of the tongue 23 is positioned to approximately contact the tongue recess 13 on the periphery of the pin wheel 12, to thereby avoid jamming or contact engagement with the coin. This arrangement tends to insure that the coin will deflectingly engage the tongue 23 for its further delivery into the chute 50. In order to completely define the balance of the chute 50, along with the deflector 19 and the chute base 64 of the knife 18, a cover plate 20 is provided as shown more specifically in FIGS. 16, 17 and 18. There it will be seen that the cover plate 20 has its lead edge optionally bent outwardly to define a gate 27. In addition, a cover top 86 is defined by a flange perpendicular to the body portion, and of course cooperates with the chute base 64 and the sides of the deflector 19 and cover plate 20 to define the chute with an open mouth defined by the gate 27 and tongue 23. The cover plate is provided with a pivot mounting hole 88 and adjustment hole 89. Thus the pivot screw 91 and adjustment screw 92 (See FIG. 8) both hold the cover plate 20 in clamped relation to the knife 18, and permit adjustment of the knife 18 when various sized shelf wheels 14 are employed. The trailer 90 of the cover plate 20 is bent slightly outwardly as shown in FIG. 18 to accommodate any coins which may be at that height in the hopper, and deflect the same from the pin wheel 12 at that point.

In review, it will be seen that a hopper payout for various coin denominations 10 has been shown and described in which simple adjustments, and inexpensive replacement spare parts, make it possible to accommodate a wide variety of coin denominations including thickness and diameter. By replacing the shelf wheel 14 and agitator 15, the same being done by the removal of the three mounting screws 61, a different shelf wheel diameter and, where required, different size agitator 15 may be inserted. Thereafter, the only additional adjustment to be made by the operator is to loosen the securing mechanism 39 for the pivotal knife 18, and pivot the same around pivot point 38 until the knife edge wiper 16 is immediately adjacent the periphery of the shelf wheel 14 in place. It will be further noted that the cones 41 are positioned on the legs 42 of the cone spider 40 so that even as the shelf wheel 14 is reduced in diameter to accommodate larger coins, the position and orientation of the yieldably secured cones 41 remains the same. The same is true with regard to the hopper gutter 32, and also the wiper 16, since the wiper finger 17 is positioned immediately atop the pins 21, and the latter will always be engaging and urging the coins forwardly in the space between the adjacent pins 21. The parts such as the pin wheel 12 and shelf wheel 14 as well as agitator 15 and cone spider 40 may all be made of stampings, thereby significantly reducing costs. In addition, the side brackets 24 as well as the base 26 can be formed of stampings. Little or no machine parts are required, and because of the precision dimension insured by means of the three-point suspension roller orientation of the pin wheel 12, precision and dimension in the sensitive area between the knife pickup and chute 50 can be maintained under operating conditions.

Although particular embodiments of the invention have been shown and described in full here, there is no intention to thereby limit the invention to the details of such embodiments. On the contrary, the intention is to cover all modifications, alternatives, embodiments, usages and equivalents of a HOPPER PAYOUT FOR VARIOUS COIN DENOMINATIONS as fall within the spirit and scope of the invention, specification and the appended claims.

We claim:

1. A hopper payout for various coin denominations comprising, in combination a hopper having a peripheral gutter on to which coins are gravitationally urged, a pin wheel rotatably mounted at one end of said hopper in coin collecting relationship with the gutter, a removable and replaceable shelf wheel mounted atop the pin wheel, and at a preselected diametrical relationship to the diameter of the pin wheel depending on the size of coin adapted for, a plurality of radially spaced pins on the pin wheel between the periphery of the shelf wheel and the periphery of the pin wheel, a pivotally adjustable knife having a point portion positioned to pick up coins adjacent the periphery of the shelf wheel, chute means in coin delivery communication with the knife point and downstream therefrom, drive means engaging the pin wheel to deliver coins from a lower portion of the gutter beyond the upper portion of the hopper in accordance with a preselected start and stop signal.

2. In the hopper payout for various coin denominations of claim 1 above, agitating means including a plurality of cones positioned radially and projecting through the shelf wheel and yieldably secured thereto by means of a cone spider secured behind the shelf wheel and pin wheel.

3. In the hopper payout for various coin denominations of claim 2, said cone spider having a plurality of yieldable legs, and a drive pad positioned centrally of the legs and cones of said cone spider, said drive pad being proportioned for engagement with a pin positioned radially on the drive shaft of the drive means.

4. In the hopper payout for various coin denominations defined in claim 3 above, said cone spider having legs extending substantially in a cirvelinear path and defining substantially the circumference of a circle having a diameter slightly in excess of the locus of the points of the cones secured to the leg portions.

5. In the hopper payout for various coin denominations of claim 4 above,

16 pins positioned adjacent the periphery of said pin wheel.

6. In the hopper payout for various coin denominations of claim 1, an agitator comprising a three-legged member secured to the face of the shelf wheel, said agitator member having a plurality of legs, each said leg having an upstanding bounding member, the same being positioned centrally atop the shelf plate of the hopper payout.

7. In the hopper payout for various coin denominations of claim 6, the ends of the legs of said agitator being bent, recess means in the shelf wheel to receive the bent ends of the agitator, whereby the scuffing and scratching of coins through the end portion of the legs is reduced by recessing the same within the holes provided in the shelf plate.

8. In the hopper payout for various coin denominations of claim 1, said chute for delivery being defined by a deflector, said deflector having a tongue diverging substantially against the peripheral edge of the pin wheel, and a cover plate positioned adjacent and parallel to said deflector.

9. In the hopper payout for various coins denominations defined in claim 1, said knife having a pickup point and a rail defining a base of the chute means, and a bypass deflector at the intersection of the pickup and prior to the positioning of the rail, said bypass having an extended position relative to the coin passing thereby to the rail portion.

10. In the hopper payout for various coin denominations defined in claim 1, pivotal means for pivotally mounting the hopper, drive mechanism, and rotary members, yieldable means at a lower portion of said hopper in the weight relationship to the loaded hopper, means for adjusting said yieldable means, a relay means for actuation determined empirically on a quantity of coins within the hopper to thereby actuate deflecting means to divert additional coins from entry into the hopper.

11. In the hopper payout for various coin denominations of claim 1, at least three roller bearing suspensions of the pin wheel at its periphery, and a drive means at a mid portion of the pin wheel whereby the peripheral track of the pin wheel is determined by the bearings.

12. In the hopper payout for various coin denominations of claim 11, said roller support having grooves in each said roller said pin wheel having a knife edge at its periphery proportioned for engagement with the grooves in the suspension rollers.

13. In the hopper payout for various coin denominations defined in claim 11, at least one of said roller suspension means said pin wheel having yieldable means for urging the same into contact with the periphery of the pin wheel thereby yieldably dimensionally orienting the pin wheel.

14. In the hopper payout for various coin denominations of claim 1, each of the pins in the pin wheel being formed by a punching operation, and having recesses therebehind of relieved metal defining the same.

15. In the hopper payout for various coin denominations of claim 1, said shelf wheel having a diameter fixed in accordance with the following formula:

$$A = B - (2d + 2t \pm .040.)$$

where $A$ is the shelf wheel diameter, $B$ is the hopper gutter diameter, $d$ equals the coin diameter, and $t$ equals the coin thickness.

16. A hopper payout for various coin denominations comprising, in combination, a hopper, a pin wheel rotatably mounted at one end of said hopper, a removable and replaceable shelf wheel mounted atop the pin wheel, and at a preselected diametrical relationship to the diameter of the pin wheel depending on the size of coin adapted for, a plurality of radially spaced pins on the pin wheel between the periphery of the shelf wheel and the periphery of the pin wheel, a pivotally adjustable knife having a point portion positioned to pick up coins adjacent the periphery of the shelf wheel, chute means in coin delivery communication with the knife point and downstream therefrom, a roller suspension for the pin wheel mounting the same at its periphery, drive means engaging the pin wheel, and a progressively widening helical gutter in said hopper for the relief of jams and shingling within the gutter for varying diameter and thickness coins as the same are fed to a counter and through the chute means.

17. In the hopper payout for various coin denominations of claim 16, at least three roller bearing suspensions of the pin wheel at its periphery, and a drive means at a mid portion of the pin wheel whereby the peripheral track of the pin wheel is determined by the bearings.

18. In the hopper payout for various coin denominations defined in claim 17, at least one of said roller suspension means of said pin wheel having yieldable means for urging the same into contact with the periphery of the pin wheel thereby yieldably dimensionally orienting the pin wheel.

19. In the hopper payout for various coin denominations defined in claim 16, pivotal means for pivotally mounting the hopper, drive mechanism, and rotary members, yieldable means at a lower portion of said hopper in the weight relationship to the loaded hopper, means for adjusting said yieldable means, a relay means for actuation determined empirically on a quantity of coins within the hopper to thereby acutate deflecting means to divert additional coins from entry into the hopper.

20. In the hopper payout for various coin denominations of claim 16 above, agitating means including a plurality of cones positioned radially and projecting through the shelf wheel and yieldably secured thereto by means of a cone spider secured behind the shelf wheel and pin wheel.

21. In the hopper payout for various coin denominations of claim 16, said chute for delivery being defined by a deflector, said deflector having a tongue diverging substantially against the peripheral edge of the pin wheel, and a cover plate positioned adjacent and parallel to said deflector.

22. In the hopper payout for various coin denominations defined in claim 16, said knife having a pickup point and a rail defining a base of the chute means, and a bypass deflector at the intersection of the pickup and prior to the positioning of the rail, said bypass having an extended position relative to the coin passing thereby to the rail portion.

23. A hopper payout for various coin denominations comprising, in combination, a hopper having a gutter into which coins are gravitationally urged, a pin wheel angularly positioned with the vertical and rotatably mounted at one end of said hopper in coin collecting relationship with the gutter, a shelf wheel atop and forward of the pin wheel at a pre-selected diametrical relationship to the diameter of the pin wheel depending upon the size of coin adapted for, a plurality of radially spaced pins on the pin wheel between the periphery of the shelf wheel and the periphery of the pin wheel, a knife having a point portion positioned to pick up coins adjacent the periphery of the shelf wheel, chute means in coin delivery communication with the knife point and downstream therefrom, a plurality of rollers engaging the pin wheel at its periphery and dimensionally orienting the same, frame means interconnecting the hopper, rollers, and knife whereby the orientation of the pin wheel is determined by the precise positioning of the peripheral rollers, and drive means engaging the pin wheel to rotate the same and thereby deliver coins from the hopper in accordance with a pre-selected start and stop signal.

24. In the hopper payout for various coin denominations of claim 23, at least three roller bearing suspensions of the pin wheel at its periphery, and a drive means at a mid portion of the pin wheel whereby the peripheral track of the pin wheel is determined by the bearings.

25. In the hopper payout for various coin denominations of claim 23, said roller support having grooves in each said roller said pin wheel having a knife edge at its periphery proportioned for engagement with the grooves in the suspension rollers.

26. In the hopper payout for various coin denominations defined in claim 23, at least one of said roller suspension means said pin wheel having yieldable means for urging the same into contact with the periphery of the pin wheel thereby yieldably dimensionally orienting the pin wheel.

27. A hopper payout device of the inclined rotating disc type for coins comprising, in combination, a hopper proportioned for feeding coins from its lower portion, an inclined pin wheel rotatably mounted at one end of said hopper, a shelf wheel mounted on the pin wheel, at a preselected diametrical relationship to the diameter of the pin wheel depending on the size of coin adapted for, a plurallity of coin engaging means on the pin wheel between the periphery of the shelf wheel and the periphery of the pin wheel, a knife having a point portion positioned to pick up coins adjacent the periphery of the shelf wheel, chute means in coin delivery communication with the knife point and downstream therefrom, a roller suspension oriented in at least three locations for the pin wheel rotatably mounted the same as its periphery, and drive means including a centrally positioned drive shaft, an offset member secured to said drive shaft for eccentric indirect drive, and eccentric drive engaging means coupled to the pin wheel, whereby the rolling orientation and support of the pin wheel is a function of the peripheral support of the roller suspension, and the drive is an indirect coupling between the basic drive means and the pin wheel.

28. The device of claim 27 wherein the rollers are both thrust and journal members and have grooves engaging with the peripheral edge of the pin wheel.

29. The device of claim 27 wherein said shelf wheel is a circular plate removably attached to the pin wheel and replaceable in desired diameters according to the diameter of coins to be transported.

30. The device of claim 27 above wherein said knife and chute means are constructed, shaped, and adjustably attached relative to the disc and coin support for changeable positioning relative to said support in accordance with the diameter of coin the support is required to carry.

31. A hopper payout for various coin denominations comprising, in combination a hopper, a pin wheel rotatably mounted at one end of said hopper, a removable and replaceable shelf wheel mounted atop the pin wheel, and at a preselected diametrical relationship to the diameter of the pin wheel depending on the size of coin adapted for, a plurality of radially spaced pins on the pin wheel between the periphery of the shelf wheel and the periphery of the pin wheel, a pivotally adjustable knife having a point portion positioned to pick up coins adjacent the periphery of the shelf wheel, chute means in coin delivery communication with the knife point and downstream therefrom, drive means engaging the pin wheel to deliver coins from the hopper in accordance with a preselected start and stop signal, said knife having a pickup point and a rail defining a base of the chute means, and a bypass deflector at the intersection of the pickup and prior to the positioning of the rail, said bypass having an extended position relative to the coin passing thereby to the rail portion.

32. A hopper payout for various coin denominations comprising, in combination a hopper, a pin wheel rotatably mounted at one end of said hopper, a removable and replaceable shelf wheel mounted atop the pin wheel, and at a preselected diametrical relationship to the diameter of the pin wheel depending on the size of coin adapted for, a plurality of radially spaced pins on the pin wheel between the periphery of the shelf wheel and the periphery of the pin wheel, a pivotally adjustable knife having a point portion positioned to pick up coins adjacent the periphery of the shelf wheel, chute means in coin delivery communication with the knife point and downstream therefrom, drive means engaging the pin wheel to deliver coins from the hopper in accordance with a preselected start and stop signal, pivotal means for pivotally mounting the hopper, drive mechanism, and rotary members, yieldable means at a lower portion of said hopper in the weight relationship to the loaded hopper, means for adjusting said yieldable means, a relay means for actuation determined empirically on a quantity of coins within the hopper to thereby actuate deflecting means to divert additional coins from entry into the hopper.

33. A hopper payout device of the inclined rotating disc type for coins comprising, in combination, a hopper proportioned for feeding coins from its lower portion, an inclined pin wheel rotatably mounted at one end of said hopper, a shelf wheel mounted on the pin wheel, and at a preselected diametrical relationship to the diameter of the pin wheel depending on the size of coin adapted for, a plurality of coin engaging means on the pin wheel between the periphery of the shelf wheel and the periphery of the pin wheel, a knife having a point portion positioned to pick up coins adjacent the periphery of the shelf wheel, chute means in coin delivery communication with the knife point and downstream therefrom, a roller suspension oriented in at least three locations for the pin wheel rotatably mounted the same at its periphery, drive means engaging the pin wheel at a central portion, and said hopper having a coin feeding gutter opposite the lower region of pin wheel and increasingly spaced away from the pin wheel at a helix angle increasing in the direction of rotation of the disc to progressively widen the gutter and relieve coin jamming.

34. A hopper payout device of the inclined rotating disc type for coins comprising, in combination, a hopper proportioned for feeding coins from its lower portion, an inclined pin wheel rotatably mounted at one end of said hopper, a shelf wheel mounted on the pin wheel, at a preselected diametrical relationship to the diameter of the pin wheel depending on the size of coin adapted for, a plurality of coin engaging means on the pin wheel between the periphery of the shelf wheel and the periphery of the pin wheel, a knife having a point portion positioned to pick up coins adjacent the periphery of the shelf wheel, chute means in coin delivery communication with the knife point and downstream therefrom, a roller suspension oriented in at least three locations for the pin wheel rotatably mounted the same as its periphery, drive means engaging the pin wheel at a central portion, and wherein said shelf wheel is a circular plate removably attached to the pin wheel and replaceable in desired diameters according to the diameter of the coins to be transported.

35. A hopper payout device of the inclined rotating disc type for coins comprising, in combination, a hopper proportioned for feeding coins from its lower portion, an inclined pin wheel rotatably mounted at one end of said hopper, a shelf wheel mounted on the pin wheel, at a preselected diametrical relationship to the diameter of the pin wheel depending on the size of coin adapted for, a plurality of coin engaging means on the pin wheel between the periphery of the shelf wheel and the periphery of the pin wheel, a knife having a point portion positioned to pick up coins adjacent the periphery of the shelf wheel, chute means in coin delivery communication with the knife point and downstream therefrom, a roller suspension oriented in at least three locations for the pin wheel rotatably mounted the same as its periphery, drive means engaging the pin wheel at a central portion, wherein said knife and chute means are constructed, shaped, and adjustably attached relative to the disc and coin support for changeable positioning relative to said support in accordance with the diameter of coin the support is required to carry.

* * * * *